United States Patent [19]

Schaefer et al.

[11] 3,996,412

[45] Dec. 7, 1976

[54] ALUMINUM MELTING FURNACE

[75] Inventors: Carl W. D. Schaefer; Richard L. Schaefer, both of Dayton; Gordon F. Kennedy, Miamisburg, all of Ohio

[73] Assignee: Frank W. Schaefer, Inc., Dayton, Ohio

[22] Filed: Jan. 17, 1975

[21] Appl. No.: 541,883

[52] U.S. Cl. ..... 13/20; 75/68 R

[51] Int. Cl.[2] ..... H05B 3/00

[58] Field of Search ..... 13/20, 22, 25; 75/68 R

[56] References Cited

UNITED STATES PATENTS

| | | | |
|---|---|---|---|
| 2,254,809 | 9/1941 | Tharaldsen | 13/20 X |
| 3,240,590 | 3/1966 | Schmidt et al. | 75/68 R X |
| 3,514,519 | 5/1970 | Schempp et al. | 13/20 |

*Primary Examiner*—R. N. Envall, Jr.
*Attorney, Agent, or Firm*—Dybvig & Dybvig

[57] ABSTRACT

An electrically energized aluminum melting furnace comprises a vessel for supporting molten aluminum and a roof and upper wall structure cooperating with side walls of the vessel to define a heating chamber above the molten aluminum. A plurality of unshielded resistance heating elements are supported by the roof and upper wall structure above the molten aluminum. The molten aluminum has access through a submerged opening to a charging well to which unmelted aluminum is periodically charged without danger that molten aluminum will splash upon the heating elements. Heat conducted from the heating chamber through the body of molten aluminum residing in the vessel is utilized to melt in the charging well the aluminum charged thereto. The melted aluminum in the charging well is permitted to flow through the heating chamber and through a submerged opening to a hot metal well from which hot metal may be withdrawn by any of numerous techniques. The heating chamber is so arranged that an oxide skin is preserved at the surface of the molten aluminum residing within the heating chamber, the oxide skin effecting an efficient transfer of radiant energy received from the resistance heating elements to the molten aluminum. The aforementioned roof and upper wall structure is rested upon furnace walls so as to allow a vertical growth of the furnace walls.

12 Claims, 6 Drawing Figures

ALUMINUM MELTING FURNACE

BACKGROUND OF THE INVENTION

1. Field of the Invention

The present invention relates to metallurgical furnaces of the type utilized in the melting of aluminum and, more particularly, to such furnaces in which the source of melting heat comprises electrically powered silicon carbide resistance elements so arranged as to be capable of melting aluminum from its solid or room temperature state by irradiation with electromagnetic radiation.

2. Description of the Prior Art

The following United States patents illustrate various furnace arrangements for use in the melting of aluminum and other metals:

| Patent No. | Patent No. |
|---|---|
| 1,924,201 | 3,240,915 |
| 1,995,524 | 3,688,007 |
| 2,552,648 | 3,700,224 |
| 2,682,566 | |

The foregoing patents reveal that it is known to utilize electrically energized resistance elements in the melting of various types of metals in melting furnaces. The patents also reveal that aluminum in particular is difficult to melt by direct utilization of the electromagnetic energy produced by resistance heating elements because aluminum does not strongly absorb such radiation. Accordingly, it has been the practice, when using electrical resistance elements, to rely on the resistance elements primarily to heat the atmosphere residing in the furnace and to employ forced air circulation or the equivalent to deliver the heat energy to the aluminum which is to be melted. Examples of forced air circulation for the melting of aluminum with resistance heating elements appear in U.S. Pats. No. 1,924,201 and 1,995,524. U.S. Pat. No. 3,700,224 illustrates the use of electrically energized resistance elements in an aluminum melting furnace without forced air circulation. U.S. Pat. No. 3,688,007 illustrates the use of electrical resistance elements which are housed in a submersible, heat exchanging medium. In this latter patent, heat conduction, as opposed to direct electromagnetic irradiation, is being used. Prior to the present invention it has been generally thought not practical to utilize resistance heating elements such as silicon carbide elements for the melting of aluminum by direct irradiation of the aluminum.

SUMMARY OF THE INVENTION

In the present invention, an aluminum melting furnace is provided with a heating chamber which is normally filled with molten aluminum to a preferred melt level. The molten aluminum in the heating chamber has continuing access through an opening submerged in the molten aluminum to a charging and melting well. The molten aluminum in the heating chamber also has continuing access through a second submerged opening to a hot metal well from which molten aluminum is periodically removed. In a continuing process, solid aluminum is periodically charged to the charging well and is melted in the charging well by reason of contact with the molten aluminum residing in the charging well.

Radiant energy emanating from resistance heating elements, which may be silicon carbide elements, located in the heating chamber continuously irradiates an aluminum oxide skin which forms naturally upon the surface of the molten aluminum in the heating chamber. The oxide skin serves as a heat transfer medium in which radiant energy from the silicon carbide elements is absorbed and from which the energy is transferred by conduction to the molten aluminum. A migration of heat energy from the molten aluminum in the heating chamber to the charging well provides a continuously available supply of heat energy in the charging well for melting the aluminum periodically introduced into the charging well. The charging well thus serves as a melting chamber.

The molten aluminum in the heating chamber also has continuous access through a submerged opening to a hot metal well from which molten aluminum is periodically withdrawn. In the preferred embodiment described, the charging well, the heating chamber and the hot metal well are located in line, whereby solid metal charged to the charging well at one end of the furnace is melted and the molten aluminum flows through the heating chamber to the hot metal well from which the molten aluminum may be removed as needed.

The operation of the furnace may be initiated by supplying previously melted aluminum to the charging well from a pre-existing melting or holding furnace. Alternately, it is possible to place solid aluminum in the heating chamber and cause melting to occur in the heating chamber without relying upon a pre-existing source of molten aluminum.

DETAILED DESCRIPTION OF THE PREFERRED EMBODIMENTS

Figure 1:
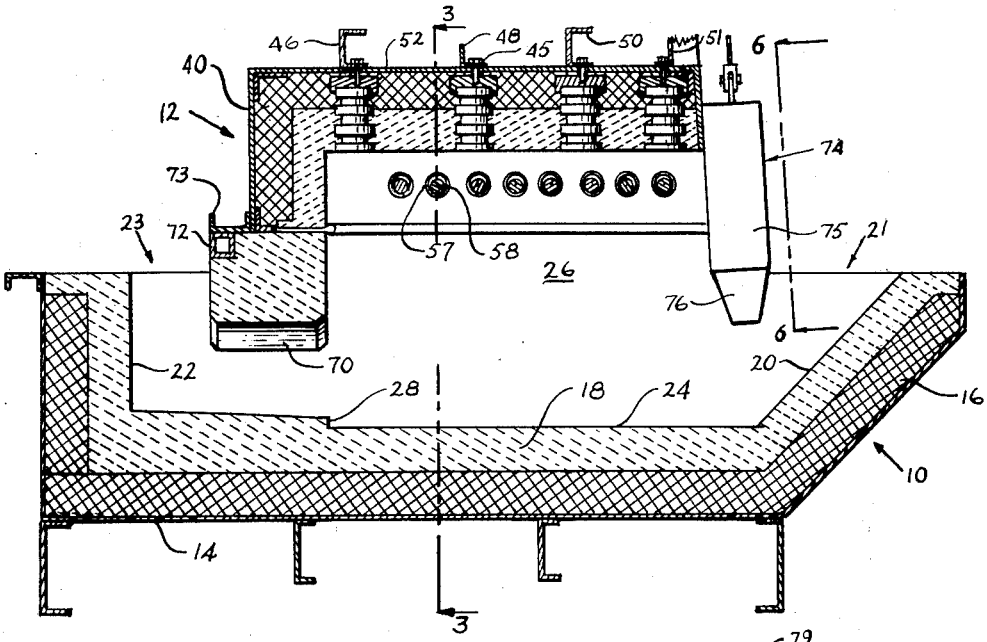
FIG. 1 is a longitudinal view with parts broken away and omitted and with parts in section illustrating an aluminum melting furnace in accordance with the present invention before aluminum has been introduced into the furnace.

The melting furnace of the present invention comprises a vessel or reservoir 10 which is adapted to receive melted aluminum and a roof and upper wall structure 12 mounted upon the side walls of the vessel 10. The vessel comprises a structurally reinforced steel casing 14 which receives a layer 16, sometimes referred to as a backup layer, which comprises an insulating, castable refractory. Alternately, the layer 16 may comprise a high temperature block insulation. The backup layer 16 is lined or faced with a non-wetting, high alumina hot face lining 18.

The vessel 10 has a sloping wall 20 located at one end thereof. As will be more fully described, the sloping wall 20 forms one wall of the charging well 21 to which solid aluminum can be charged. The sloping wall 20 also allows dross, which may settle out of molten aluminum within the melting furnace, to be dredged out of the melting furnace.

The vessel 10 also has a sharply rising wall 22 at the end thereof which is opposite the sloping wall 20. The wall 22 forms part of a hot metal well 23 from which molten aluminum may be ladled, poured, tapped, pumped or otherwise removed. The charging well and the hot metal well have a common floor 24 which extends under a heating chamber 26 to be more fully described. The floor 24 is interrupted by a dross dam 28 which prevents dross settling from the molten aluminum under the heating chamber from entering the hot metal well.

Figure 3:
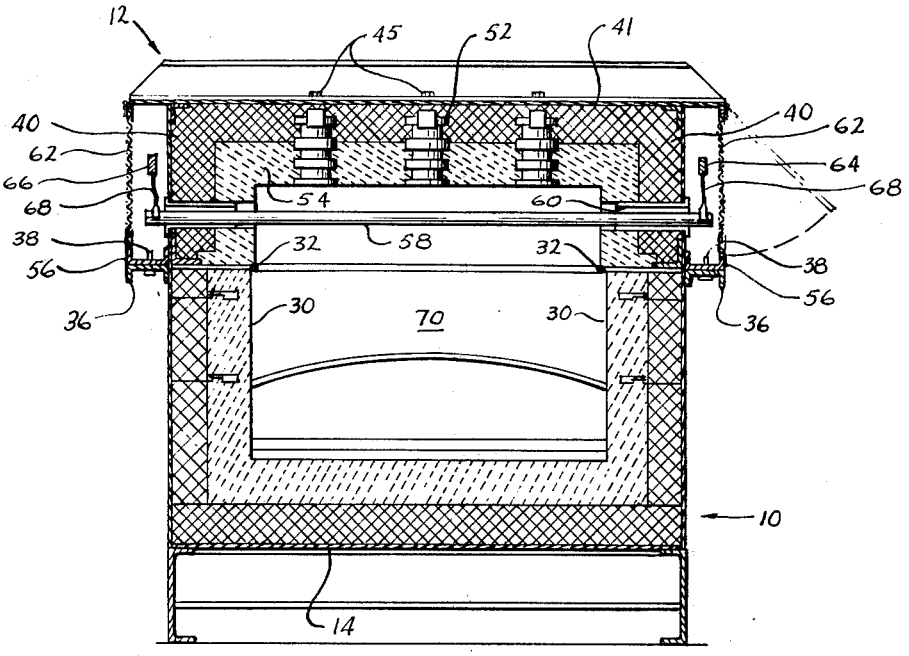
FIG. 3 is a section view taken substantially along the line 3—3 of FIG. 1.

Referring to FIG. 3, it can be seen that the vessel 10 has vertically disposed and generally planar interior side walls 30 which extend longitudinally between the charging well and the hot metal well. The side walls in the region between the hot metal well and the charging well extend upwardly to a level above both of the charging and hot metal wells. Longitudinally extending channel irons are mounted to the outside surfaces of the walls 30 with the channels thereof opening downwardly. At spaced intervals along the length of each of the channel irons 36, centrally located upstanding guide pins 38 are provided.

Referring to the roof and upper wall structure 12, the structure is assembled in a structurally reinforced steel casing 41. Lying across the top of the casing are spaced structural beams 46, 48, 50 and 51. Disposed within the casing are anchor pieces 52 which are anchored to the structural beams by suitable fastener means 45 passing through the wall of the casing. Lining the interior wall of the casing is a layer 40 of high temperature block insulation, or other suitable insulating material. The layer 40 is lined with a hot face lining 54 which is preferably a super-duty grade refractory.

As appears in FIG. 3, the roof structure 12 is sized to seat upon the opposite side walls 30 of the vessel 10, the sides of the roof structure extending upwardly from the side walls 30. As appears in FIG. 1, however, the longitudinal length of the roof structure is substantially smaller than the longitudinal length of the vessel 10.

Prior to the time the roof structure 12 is lowered upon the side walls 30 of the vessel 10, the upper margins of the side walls 30 are covered with a ceramic cushion 32, which is compacted due to the weight of the roof structure 12 placed thereon. As is evident, the cushion 32 has a margin which projects slightly into the heating chamber 26. The heating chamber 26 is thus defined in part by the interior walls 30 of the vessel 10, the face lining 54 of the roof structure and the cushion 32, which separates the roof structure from the vessel 10.

When the roof structure 12 is assembled onto the vessel 10, channel irons 56 extending longitudinally along the sides of the roof structure rest upon the channel irons 36 at the sides of the vessel 10. The channel irons 56 have channels which open upwardly as they appear in FIG. 3. The channel irons 56 are bored centrally at spaced intervals to receive the previously mentioned guide pins 38. The guide pins 38 act to locate the roof structure 12 above the vessel 10 and to structurally tie the sides of the roof structure, which otherwise tend to bow outwardly after prolonged use of the furnace.

The sides of the roof structure have holes 57 located at spaced intervals to receive resistance heating elements 58. As apparent in FIG. 3, the resistance heating elements 58 traverse the interior of the roof structure 12 and are of sufficient length to project outwardly of the roof structure through the holes 57 located in opposite sides thereof. The resistance heating elements are preferably silicon carbide resistance bars which, by reason of conductive portions at the ends thereof, are energized and thus emit electromagnetic radiation only in the central portions thereof which extend between the side walls 30. Each of the holes 57 through which the heating elements 58 are assembled is lined with a ceramic sleeve 60.

The aforementioned structural steel members 46 and 50, which extend across the top of the roof structure, project laterally outwardly from the roof structure to overhang the roof structure. Hinged to the overhanging portions of the steel members 46 and 50 and extending downwardly to the channel irons 56 disposed on opposite sides of the roof structure are framed expanded metal sheets 62 which shield the ends of the heating elements 58. Also shielded by the sheets 62 are bus bars 64 and 66. Electrical connectors 68 connect the bus bars to the resistance heating elements. Because the connectors 68 are located outside the roof structure, the possibility of damage to the connectors by exposure to excessive heat is eliminated.

Underlying the roof structure 12 is a submergible arch member 70 which spans between the backup layers 16 lining the interior of the vessel 10. The arch 70 is formed of the same material as used to form the lining 18 and is integrally attached to the lining. Embedded in and extending across the top of the arch member 70 is a hollow rectangular member 72 to which is fastened a channel member 73 which crosses the top of the arch member 70 and resists the tendency of the adjacent side of the roof structure 12 to bow outwardly.

As appears in FIG. 3, the arch member 70 is spaced above the floor 24 of the vessel 10 and provides a passageway for the flow of melted aluminum to the hot metal well 23.

Figure 6:
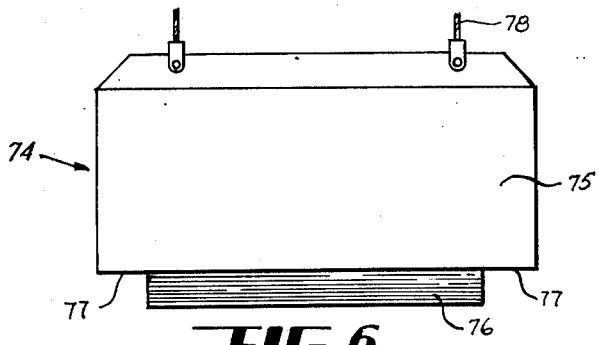
FIG. 6 is an elevation view of a furnace door viewed in the direction indicated by the line 6—6 of FIG. 1.

Flanking the sides of the roof structures at the end of the roof structure which is opposite the arch member 70 are a pair of structural steel members 88, only one of which appears in the drawings. These members are inclined to the vertical so as to lean slightly toward the center of the furnace. Each of the members 88 supports a gusset 90, only one of which appears in the drawings, and the gussets support a door header 92. Journalled in the door header are pulley means 79, over which a cable means 78 passes. The cable means 78 is anchored to an air cylinder, not shown, and supports a vertically disposed and vertically adjustable arch or door 74, which is best illustrated in FIG. 6. The upper portion 75 of the door 74 has outwardly projecting shoulders 77 which can rest upon the upper surfaces of the side walls 30. The lower portion 76 has a smaller width which enables the portion 76 to fit snugly between the side walls 30, whereby the lower portion 76 enters the charging well 21. For this reason, at least the lower portion 76 is formed of a non-wetting ceramic material which can withstand prolonged submersion in the molten aluminum that ordinarily resides in the charging well.

Due to the vertically inclined position of the steel members 88, the gravitational pull on the door 74 biases the door toward the roof structure 12 and, as appears in FIG. 1, the upper portion 75 of the door passes immediately adjacent the roof structure 12, thus cooperating with the roof structure to minimize heat losses from the heating chamber.

For reasons that will become more apparent, the aforementioned air cylinder is designed to move the door 74 vertically between two extremes, a lower one in which the lower door portion 76 will be spaced above the floor 24 but nevertheless partly submerged in molten aluminum, and an upper one in which the lower portion 76 is lifted upwardly out of molten aluminum accumulated in the charging well 21. The door cooperates with the roof structure 12 to minimize heat losses in both positions. In the lower extreme, the shoulders 77 are permitted to rest upon the side walls 30, whereby the conforming fit between the door and the side walls of the vessel also provides an effective thermal seal.

Figure 2:
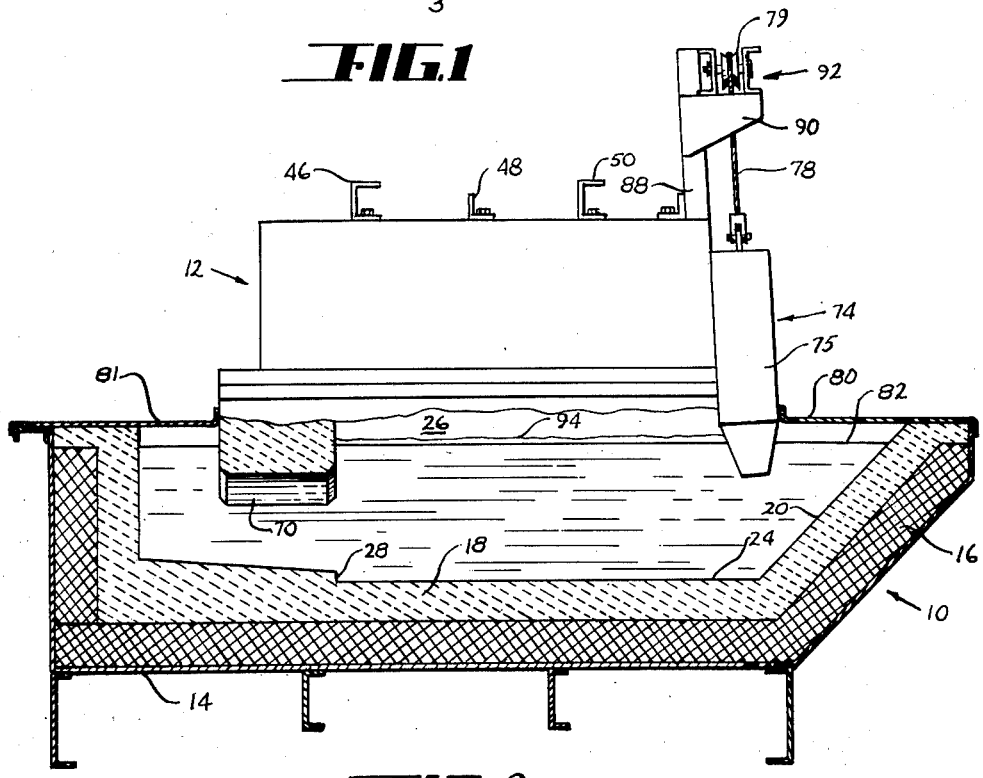
FIG. 2 is a simplified longitudinal view with parts broken away and omitted and with parts in section illustrating the furnace after molten aluminum has been accumulated in the furnace.

Ordinarily, during the operating life of the furnace the vessel 10 will contain a volume of molten aluminum which fills the vessel to approximately the level represented by the line 82 in FIG. 2, this line hereafter referred to as the metal line. With this normal volume of molten aluminum remaining in the furnace, it can be noted that the lower portions of the arch 70 as well as the door 74 are submerged in molten aluminum.

Assuming both of the arches 70 and 74 are submerged in molten aluminum, the heating chamber 26 can be seen to comprise the chamber enclosed by the roof structure 12, the arches 70 and 74, the side walls 30 of the vessel 10 and the upper surface of the molten aluminum extending between the arches 70 and 74. In effect, the arch 70 and the door or arch 74 have partitioned the vessel 10 into three wells, one well being the charging well 21, a second well being the hot metal well 23 and the third well being the portion of the vessel 10 which contains the molten aluminum lying under the heating chamber 26 between the arches 70 and 74.

While the air outside the furnace may have access to the heating chamber 26 because of a loose fit of the heating elements 58 and the sleeves 60 in the holes 57, the relatively intense heat residing in the heating chamber minimizes the opportunity for outside air to enter the heating chamber. The heating chamber 26 is thus essentially closed to the outside atmosphere.

In the normal operation, the molten aluminum, which reacts rapidly with oxygen, supports an oxide skin 94 at the surface thereof. In the charging well and the hot metal well, this oxide surface is periodically broken by the introduction of cold metal to the charging well and by the ladling or other removal of molten aluminum from the hot metal well. Within the heating chamber, however, the oxide surface is permitted to remain for indefinitely long periods with a minimum of disruption thereto.

In the intended operating mode, all unmelted aluminum introduced to the charging well is permitted to reside in the charging well until melted. Since only melted aluminum flows into the heating chamber under the submerged door 74, there is no tendency for aluminum residing under the heating chamber to be splashed upon the resistance heating elements. Also, since the aluminum oxide skin residing on the melted aluminum under the heating chamber is an efficient absorber for the primarily infrared radiation received from the resistance heating elements, an optimum flow of thermal energy from the resistance heating elements to the body of aluminum is maintained. With the described construction, it is possible to maintain a thermal head produced by radiant heat in the atmosphere immediately above the oxide skin as high as 2700° Fahrenheit (1482° centigrade). In practice, radiant heat sufficient to produce a thermal head in the range of 1700° Fahrenheit (927° centigrade) to 2100° Fahrenheit (1150° centigrade) makes it feasible, in a furnace charged at its rated capacity, to introduce unmelted aluminum to the charging well and to rely on the conduction of thermal energy under the arch 74 from the molten aluminum residing under the heating chamber 26 to accomplish the melting of the aluminum charged to the charging well.

Notable features of the present invention are that the aluminum melting occurs in the charging well outside the heating chamber and thus remotely from the resistance heating elements. This means that any contamination such as oils or greases is vaporized to the atmosphere above the charging well and does not enter the heating chamber. It is also to be noted that the submerged arches 70 and 74 cooperate with the side walls of the vessel 10 to preserve the aluminum oxide skin 94 with a minimum of disruption thereto. Thus, the only material entering the heating chamber 26 is molten material underflowing the arch or door 74, and this affects only the level of the skin 94 while not tending to disrupt the skin.

In this normal operation, the door 74 remains in its lowermost position with the shoulders 77 resting upon the walls 30. However, from time to time it may be desirable to raise the door 74 to lift its lower portion 76 out of the melted aluminum so as to allow an inspection and cleaning of the oxide skin residing in the melting chamber. When the door 74 is raised, the upper limit of the vertical travel allowed the door 74 is controlled by the aforementioned air cylinder, not shown, so that the door does not rise so high as to endanger the heating elements 58. Thus, the door 74 is permitted to rise above the metal line 82 only far enough to allow tools to be inserted for the purposes of cleaning the heating chamber, but not so high that such tools can engage and thereby possibly destroy the heating elements 58.

As shown in FIG. 2, both the charging well and the hot metal well are ordinarily covered during idle time with protective covers 80 and 81, which are preferably heat-insulating so as to minimize the escape of thermal energy from the melting furnace. Thus, the charging well is ordinarily covered with its cover 80 except when unmelted aluminum is charged to the furnace or when the door 74 is raised for an inspection of the heating chamber. Likewise, the cover 81 remains in covering relation to the hot metal well except for purposes of removing molten aluminum from the hot metal well.

One of the particular benefits of the present invention is that the aluminum oxide skin residing in the chamber 26 is found to exhibit only a minimal growth. Thus, it has been the practice in aluminum melting furnaces to remove dross and aluminum oxide accumulating in the heating chamber at frequent intervals, such as daily intervals, but in the practice of the present invention it has become possible to limit the number of instances in which the heating chamber must be cleaned of accumulated dross and oxide to intervals spaced apart by more than one week. This allows the described melting furnace to be operated on a continuing basis extending over a period of several weeks, during which the door 74 need not be elevated, although aluminum is removed from the hot metal well as required and replaced by newly added aluminum charged to the charging well.

In the foregoing remarks it has been assumed that the vessel 10 is filled with molten aluminum to the metal line 82. In some cases, this is accomplished by prefilling the melting furnace with pre-existing melted aluminum which may reside in a second melting furnace or in a holding furnace. Alternatively, it is an especial benefit to the present invention that cold metal may be charged to the heating chamber and given a prolonged exposure to the predominately infrared radiation emitted by the resistance heating elements, and, in time, the direct melting of the aluminum by the radiation emanated from the heating elements accomplished. During this phase of operation, since the arch 70 and the door 74 are not submerged in molten aluminum, the melting is initiated in a quiescent ambient atmosphere. In time, however, with the repeated introduction of new aluminum to the charging well, the accumulation of molten aluminum within the furnace reaches a level which submerges both the arch 70 and the door 74, whereupon the furnace is in readiness for the normal mode of operation described above.

It will be noted that the roof and upper wall structure 12 is, in a sense, floatably mounted upon the side walls of the vessel 10. Thus, the guide pins 38 do not anchor the roof structure to the side walls of the vessel 10, and it is therefore possible to lift the roof structure 12 from the vessel 10 for purposes of cleaning, repair or replacement.

As appears in FIG. 3, the ceramic cushion 32 is permitted to project into overhanging position above the side walls 30 of the vessel 10. This is found to provide a distinct advantage in the present invention because aluminum oxide contacted to the side walls 30 exhibits a tendency to slowly spread upon the side walls, but the presence of the overhanging portions of the ceramic cushion 32 produces a barrier which limits the tendency of the aluminum oxide to creep up the side walls 30 into the roof structure 12. A tendency of the aluminum oxide to damage the interior surfaces of the roof structure is thereby avoided.

One of the particular advantages of the floating roof structure disclosed is attributable to the fact that refractory materials, when contacted by aluminum, exhibit a tendency to absorb aluminum and to grow in proportion to the aluminum absorbed. Thus it can be noted that during prolonged use of an aluminum melting furnace such as disclosed in the present invention, the side walls 30 of the vessel 10 will literally grow. Such growth is observable by an increase in the vertical height to which the side walls extend. Thus, the roof structure 12 will be elevated due to the growth of the side walls 30. By having supported the resistance heating elements 58 in the roof structure, which does not itself grow, the resistance elements, which tend to be quite fragile, are not subjected to stresses attributable to the growth of the walls 30. More particularly, the heating elements 58, being connected to the bus bars 64 and 66 only by flexible connectors 68, are permitted to be elevated by the growth of the walls 30 without damage to the electrical connections thereto.

A common experience in the practice of the present invention is that the silicon carbide resistance elements have an operating life which is substantially smaller than the operating life of the aluminum melting furnace.

Accordingly, it is necessary to periodically replace resistance elements which have reached the end of their operating life. For this purpose, the expanded metal sheets 62 are preferably hingedly joined to the overhanging structural members 46 and 50. As illustrated with phantom lines in FIG. 3, this facilitates the removal and replacement of exhausted heating elements. Due to the lack of any fixed attachment between the heating elements and the roof structure, the replacement of heating elements is easily accomplished without prolonged interruption of the operation of the heating furnace.

Figure 4:
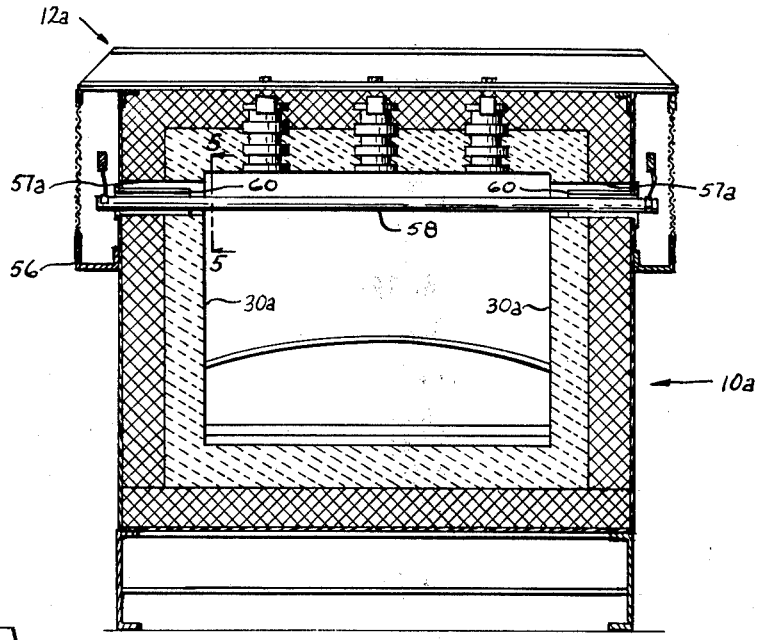
FIG. 4 is a section view analogous to that appearing in FIG. 3, showing a modification.
Figure 5:
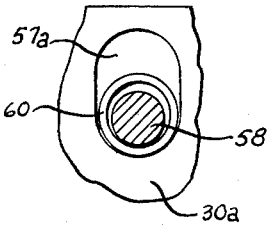
FIG. 5 is a fragmentary section view taken along the line 5—5 of FIG. 4.

FIGS. 4 and 5 illustrate a modification which does not require the floating roof structure described in reference to the preferred embodiment. For convenience, structural elements unchanged from the preferred embodiment are identified by the same reference numbers used to describe the preferred embodiment without repeated description in describing the modification. Portions which have been changed in this modification but nevertheless perform the same or a similar function in the modification have been identified with the suffix "a" in the modification shown in FIGS. 4 and 5. In the modification, the side walls **30*a* of the vessel 10*a* are extended upwardly without interruption to support an integrally attached roof structure 12*a*. The precaution that this invention teaches, however, is that the holes 57*a*, which are provided in the roof structure to receive the resistance elements 58, should be vertically elongated, thus to be oblong, so that the interior wall of the furnace chamber which contacts molten aluminum can grow vertically with respect to the outer portions of the furnace without damage to the silicon carbide resistance elements. Thus, the elongated holes 57*a* enable the refractory layers forming the furnace walls to grow vertically at differing rates without producing unreasonable shear forces acting on the silicon carbide resistance elements. While not shown, a fibrous, heat-resistant, ceramic material may be loosely packed within the holes 57*a*** and above the resistance heating elements so as to minimize heat losses through the elongated holes.

Although the preferred embodiments of this invention have been described, it will be understood that various changes may be made within the scope of the appended claims.

Having thus described our invention, we claim:

1. In an aluminum melting furnace, a vessel having a floor and side walls for accumulating molten aluminum, arch means traversing said vessel, said arch means having a lower portion spaced above said floor and adapted for submersion in molten aluminum accumulated in said vessel, said arch means by submersion in accumulated molten aluminum dividing said vessel into at least first and second wells interconnected by molten aluminum underflowing said arch means, means cooperating with said vessel, said arch means and the molten aluminum within said first well defining a closed heating chamber above and in communication with said first well, said second well disposed outside said heating chamber, and silicon carbide electrical resistance means supported in said heating chamber above the level to which molten aluminum accumulates in said vessel for radiating sufficient thermal energy directly to the surface of the molten aluminum accumulated in said first well that unmelted aluminum charged to said second well may be melted in said second well by thermal energy conducted from said first to said second well through molten aluminum underlying said arch means.

2. The furnace of claim 1 wherein said means cooperating to define a closed heating chamber includes a roof and wall portions descending from said roof, said wall portions having holes therethrough, said electrical resistance means comprising silicon carbide resistance elements extending longitudinally under said roof and outwardly of said heating chamber through said holes, said furnace further including electrical connector means engaging said electrical resistance elements outside of said heating chamber.

3. The furnace of claim 2 wherein said resistance elements extend horizontally under said roof and said holes are vertically elongated oblong holes.

4. The furnace of claim 1 wherein said arch means comprises first and second arches traversing said vessel in spaced apart relation, said first well being bounded in part by said first and second arches, both said arches cooperating to define said heating chamber, said second well disposed outside said heating chamber and said first well adjacent said first arch, said first arch comprising a movable door having a refractory portion fitted slidably between opposite side walls of said vessel, and including a third well disposed outside said heating chamber and said first well adjacent said second arch.

5. The furnace of claim 4 including means for raising said refractory portion a limited distance out of molten metal accumulated in said vessel.

6. The furnace of claim 1 wherein said arch means includes a movable door having a portion fitted slidably between opposite side walls of said vessel.

7. The furnace of claim 6 including means for raising said portion a limited distance out of molten metal accumulated in said vessel.

8. An aluminum melting furnace comprising: a vessel having a floor and side walls for continuing molten aluminum, arch means traversing said vessel and having a lower portion spaced above said floor which is adapted for submersion in molten aluminum, said arch means dividing said vessel into first and second wells adapted for interconnection by molten aluminum underflowing said arch means, means including a roof structure supported by and cooperating with said side walls and said side arch means forming a heating chamber above and in communication with said first well, said second well disposed outside said heating chamber, and silicon carbide electrical resistance heating means supported in said heating chamber, said furnace so constructed and arranged that, upon placement of molten aluminum in said vessel to a level which submerges the lower portion of said arch means, said heating chamber is closed by the molten aluminum and an aluminum oxide skin forms on the surface of said aluminum underlying said heating chamber, said silicon carbide electrical resistance means being constructed to radiate sufficient energy directly to said aluminum oxide skin to produce a thermal energy conducted through said molten aluminum and under said arch means to said second well sufficient that unmelted aluminum may be charged to said second well and melted.

9. The furnace of claim 8 wherein said arch means includes a movable door having a portion fitted slidably between opposite side walls of said vessel.

10. The furnace of claim 9 including means for raising said portion a limited distance out of molten metal accumulated in said vessel.

11. The method of melting aluminum in a furnace of the type having a vessel containing molten aluminum, having an arch submerged in said molten aluminum and partitioning said vessel into first and second wells interconnected by molten aluminum passing under said arch, and having housing means essentially enclosing a chamber above and in communication with the first of said wells; which comprises heating the molten aluminum in said first well to a temperature sufficient to melt unmelted aluminum by electrical resistance heating elements which radiate heat energy directly onto the surface of the molten aluminum, maintaining sufficient molten aluminum in said vessel so that said vessel, said arch and the molten aluminum within said first well closes said heating chamber, and depositing unmelted aluminum into the molten aluminum in said second well.

12. The method of melting aluminum in a furnace of the type having a vessel containing molten aluminum, having an arch submerged in said molten aluminum and partitioning said vessel into first and second wells interconnected by molten aluminum passing under said arch, and having housing means essentially enclosing a heating chamber above and in communication with the first of said wells; which comprises maintaining sufficient molten aluminum within said first of said wells so that said heating chamber is closed, and melting aluminum in said second well by radiating heat energy produced by electrical resistance heating elements in said heating chamber directly onto the surface of the molten aluminum in said first well so that heat energy is conducted to the second well through the molten aluminum under said arch, the heat energy produced by said heating elements and conducted to said second well being sufficient to compensate for heat absorbed in said second well by melting of said unmelted aluminum.

* * * * *

UNITED STATES PATENT OFFICE

CERTIFICATE OF CORRECTION

PATENT NO. : 3,996,412

DATED : December 7, 1976

INVENTOR(S) : Carl W. D. Schaefer et al

It is certified that error appears in the above-identified patent and that said Letters Patent are hereby corrected as shown below:

Column 4, line 44, "structures" should be ---structure---.

Column 9, line 46, after "said" delete ---side---.

Signed and Sealed this

Nineteenth Day of April 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

PATENT NO. : 3,996,412

DATED : December 7, 1976

INVENTOR(S) : Carl W. D. Schaefer et al

It is certified that error appears in the above-identified patent and that said Letters Patent are hereby corrected as shown below:

Column 9, line 38, "continuing" should be ---containing---.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*